United States Patent [19]

Saotome

[11] Patent Number: 5,034,892

[45] Date of Patent: Jul. 23, 1991

[54] APPARATUS FOR SUPPRESSING VIBRATORY OR QUAKY MOVEMENTS OF MOBILE TYPE CRANE

[75] Inventor: Yoshimi Saotome, Takasago, Japan

[73] Assignee: Kabushiki Kaisha Kobe Seiko Sho, Kobe, Japan

[21] Appl. No.: 397,888

[22] Filed: Aug. 24, 1989

[30] Foreign Application Priority Data

May 10, 1989 [JP] Japan ..... 1-118076

[51] Int. Cl.[5] ..... B66C 13/12; B66C 23/56

[52] U.S. Cl. ..... 364/424.07; 340/685; 60/418; 60/413; 60/469; 91/437; 91/464; 212/159; 212/146; 212/153; 212/182

[58] Field of Search ..... 364/424.07, 508; 212/153, 182, 187, 261; 340/685; 414/699; 188/299, 318; 60/418, 469, 461, 437; 91/437, 461

[56] References Cited

U.S. PATENT DOCUMENTS

| | | | |
|---|---|---|---|
| 4,024,796 | 5/1977 | Theobald | 91/411 R |
| 4,341,149 | 7/1982 | Dezelan | 60/413 X |
| 4,573,592 | 3/1986 | Oliphant | 212/182 |
| 4,658,970 | 4/1987 | Oliphant | 212/182 |
| 4,674,638 | 1/1987 | Oliphant | 212/182 |
| 4,718,329 | 1/1988 | Nakajima et al. | 91/445 |
| 4,953,723 | 9/1990 | Saotome et al. | 212/182 X |
| 4,969,562 | 11/1990 | Saotome | 212/182 X |

*Primary Examiner*—Parshotam S. Lall
*Assistant Examiner*—Thomas S. Auchterlonie
*Attorney, Agent, or Firm*—Oblon, Spivak, McClelland, Maier & Neustadt

[57] ABSTRACT

An apparatus for suppressing vibratory or quaky movements in travel of mobile type cranes, which facilitates the operation of re-starting the vehicle after temporarily stopping the engine, for example, at a gas station for fuel replenishment as well as operations for switching the mode of operation between vehicle travel and working modes. The apparatus includes for this purpose a memory means for storing at least information as to the mode of operation under engine working conditions before an engine cut-off, and a controller adapted to reproduce automatically the mode of operation before the engine cut-off, by setting a mode selector means in a reproducing position upon re-starting the engine based on the information stored in the memory means.

6 Claims, 6 Drawing Sheets

APPARATUS FOR SUPPRESSING VIBRATORY OR QUAKY MOVEMENTS OF MOBILE TYPE CRANE

BACKGROUND OF THE INVENTION

1. Field of the Invention

This invention relates to an apparatus for suppressing vibrations and quaky movements in travel of a mobile or automotive type crane like rough terrain cranes.

2. Prior Art

As illustrated in FIG. 5, mobile type cranes generally have a boom 3 pivotally supported on a vehicle body 2 which is supported on driven wheels 1, for pivoting movements about a horizontal shaft 5 through a boom uplifting cylinder 4. With a mobile crane of this sort, it is usually experienced that the vehicle body 2 is subjected to vibrations or quaky movements during travel due to undulations or irregularities on road surfaces or due to abrupt accelerations or decelerations of the vehicle body 2, putting the boom 3 and other attachments also in quaky movements to magnify the vibrations and quaky movements of the vehicle body 2 itself, giving ride discomfort to the operator on the vehicle.

For the purpose of damping such vibrations in travel, there has been known in the art an apparatus as disclosed in Japanese Laid-Open Patent Application 59-182195. As shown in FIG. 6, this prior art apparatus employs a damper mechanism 19 which is built in a boom uplifting cylinder 18. It includes a counter-balancing valve 12 provided in a conduit 13 in communication with an oil chamber 181 which holds the load of the cylinder 18, and an electromagnetic change-over valve 16 and a shuttle valve 15 which are provided between the conduit 13 and a conduit 17 which is connected to the other oil chamber 182 or a conduit 14 which is in communication with a direction control valve 11.

According to the prior art apparatus, if the direction control valve 11 is switched to a boom-up or boom-down position when the change-over valve 16 is in position A, the oil pressure is supplied to the oil chamber 181 or 182 of the cylinder 18 to expand or contract the cylinder 18 for moving up or down the boom. If the change-over valve 16 is switched to position B, the conduit 13 is communicated with the conduit 17 through the electromagnetic valve 16 and shuttle valve 15, forming a closed circuit through the oil chambers 181 and 182 and the oil chamber 191 of the damper mechanism 19 thereby to suppress quaky movements relative to a vehicle body 1 when the vehicle is in travel.

With this prior art apparatus, the change-over valve 16 is returned to position A by de-energization of its solenoid when the key of the vehicle is pulled out to turn off the power switch as in the case of the operator stopping the engine at a gas station for refilling fuel in the course of a vehicle driving operation with the change-over valve 16 held in position B for the vibration suppressing function. When re-starting the vehicle after refilling fuel, even if the power switch is turned on to re-start the engine, the change-over valve 16 remains in position A unless a damper switch is set in the travel position.

Namely, when re-starting the vehicle, the operator is required to switch the change-over valve 16 again into position B after re-starting the engine. If this procedure is neglected, the change-over valve 16 remains in position A during vehicle travel, failing to produce the damping effect and as a result making the ride uncomfortable.

SUMMARY OF THE INVENTION

The present invention contemplates to eliminate the above-described drawbacks or problems, and has as its object the provision of an apparatus for damping quaky movements of mobile type crane, which obviates the operation of turning on a damper switch every time when re-starting the engine for driving the vehicle after a temporary stop, for example, at a gas station for fuel replenishment. That is upon re-starting the engine, the change over switch automatically resumes the condition (the travel mode) before an engine cut-off, permitting one to re-start and drive the vehicle comfortably with the vibration damping action.

It is another object of the invention to provide an apparatus for damping vibratory or quaky movements of mobile type crane, which can be switched smoothly between the working mode and the vehicle travel mode, coupled with smooth resetting in the vehicle travel mode position.

In accordance with the present invention, there is provided an apparatus for suppressing vibratory or quaky movements of a mobile type crane, which essentially includes: a boom pivotally supported on a vehicle body through a hydraulic cylinder for pivoting movements about a horizontal shaft; a direction control valve for selectively supplying and draining discharge oil pressure of a main hydraulic pump to and from a first load-holding oil chamber and an opposing second oil chamber of a hydraulic cylinder; a counter-balancing valve provided between the hydraulic cylinder and the direction control valve; an accumulator provided between the hydraulic cylinder and the counter-balancing valve for suppressing vibrations of the vehicle body; a mode selector means selectively switchable between a travel mode position for communicating the first and second oil chambers with each other through a closed circuit in communication with the accumulator and a working mode position for cancelling the closed circuit and supplying oil pressure to and from the first and second oil chambers independently of each other; memory means for storing information as to whether or not the mode of operation under engine working condition is the vehicle travel mode; and a controller adapted to reproduce the mode of operation immediately before an engine cut-off and to set the mode selector means in a reproducing position upon re-starting the engine based on the information stored in the memory means.

With this arrangement, it is convenient to provide a memory means which is capable of storing information as to whether or not the accumulated pressure of the accumulator is an appropriate value for vehicle travel.

Further, in a preferred form of the invention, the apparatus further includes a main hydraulic pump which is disconnectibly coupled with the engine through a transmission mechanism, and an auxiliary hydraulic pump which is constantly driven from the engine. The mode selector means includes: a first change-over valve selectively switchable between a working mode position for blocking oil flow from the first to second oil chamber, and a travel mode position for communicating the two oil chambers with each other; a second change-over valve selectively switchable between a working mode position for blocking oil flow from the second oil chamber to the accumulator, and a travel mode position for communicating the second oil chamber with the accumulator; a main pilot check valve oriented to block oil flow from the second oil chamber to the direction control valve; an auxiliary pilot check valve oriented to block oil flow from the accumulator to a drain conduit; and a third change-over valve selectively switchable between a working mode position for applying the pilot pressure from the auxiliary pump to a valve-opening pilot conduit for opening the pilot check valves, and a travel mode position for communicating the pilot conduit with a tank.

The apparatus may further include a fourth change-over valve which is selectively switchable between a replenishing position for supplying the oil pressure from the auxiliary pump to the accumulator and a blocking position for inhibiting the pressure replenishment.

There may be employed a piloted change-over valve for the first change-over valve, which is held in the working mode position when the pilot pressure applied from the accumulator conduit between the second change-over valve and the accumulator is lower than a preset level, and switched to the travel mode position when higher than the preset level, while employing electromagnetic valves for other change-over valves.

The vibration damping apparatus may further include a transmission switch which turns on and off the power transmission mechanism, and a damper switch which selects or deselects the travel mode of the mode selector means, the controller being adapted to control the switching operation of the mode selector means according to signals from these switches and from the memory means.

With the above-described arrangement, in vehicle driving operations with the mode selector means in the vehicle travel mode position, the comfort of ride is improved by the damping action of the accumulator. If the engine is cut off in the course of a vehicle driving operation, the operating condition immediately before the engine cut-off is stored in the memory, and upon re-starting the engine the mode selector means is controlled to resume the vehicle travel mode automatically according to the memory contents to effect the damping action during the vehicle driving operation. This improves the maneuverability significantly since there is no need for re-setting the mode selector means in the vehicle travel mode at the time of re-starting the vehicle.

Further, the combination of the above-mentioned change-over valves makes the control of each of the working and vehicle travel modes very smooth.

The above and other objects, features and advantages of the invention will become apparent from the following description, taken in conjunction with the accompanying drawings which show by way of example preferred embodiments of the invention.

DESCRIPTION OF PREFERRED EMBODIMENTS

Figure 1:
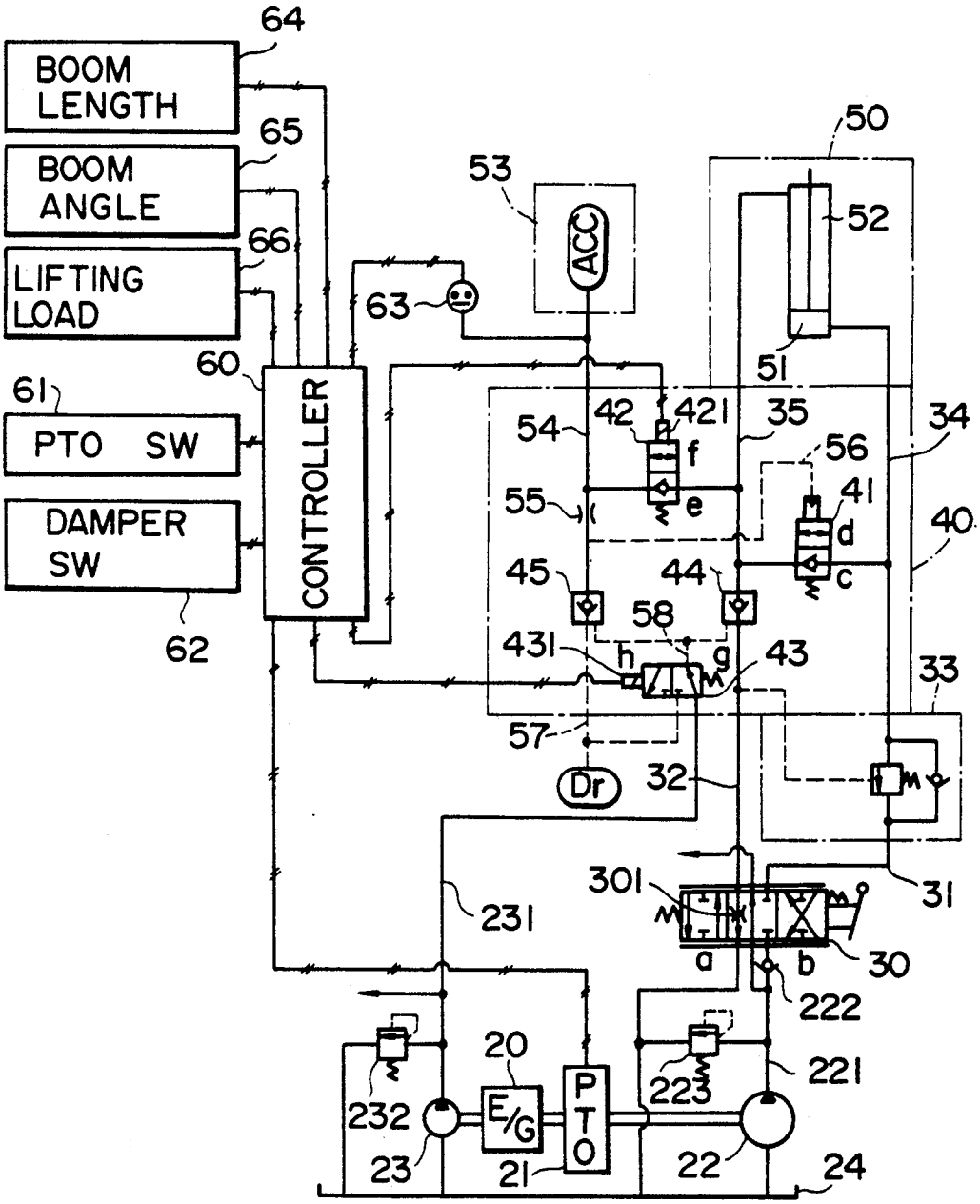
FIG. 1 is a diagram of a hydraulic circuit embodying the present invention.
Figure 5:
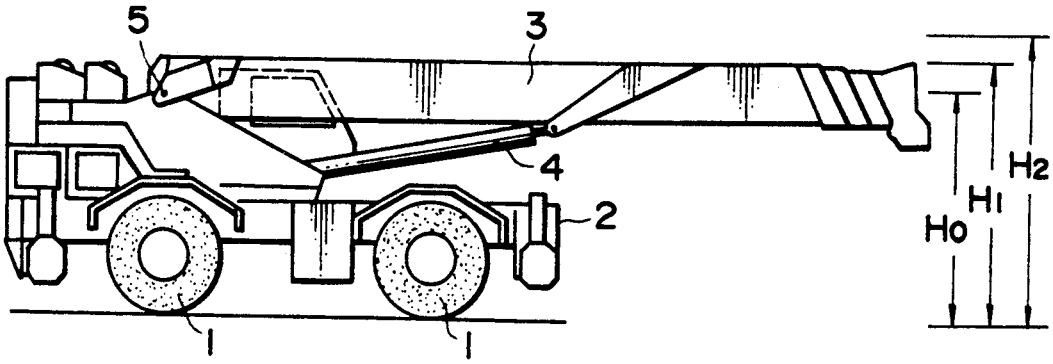
FIG. 5 (PRIOR ART)
FIG. 5 is a schematic side view of a mobile type crane.
Figure 6:
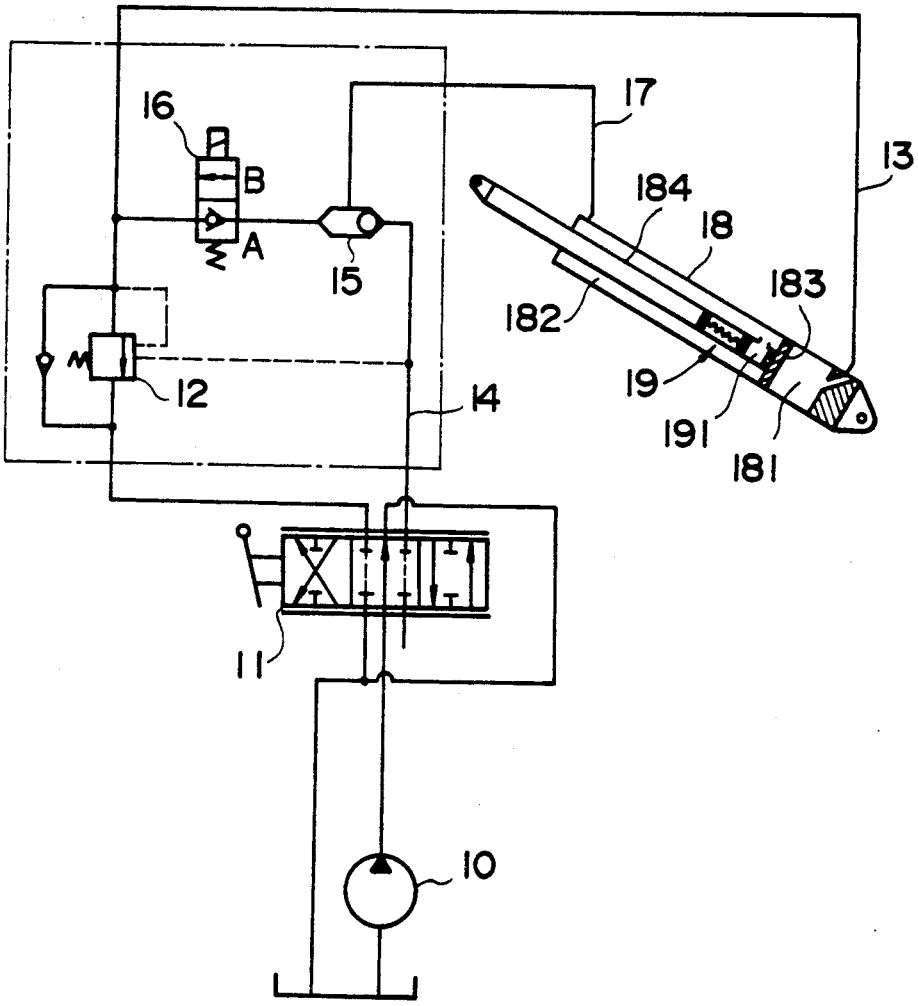
FIG. 6 (PRIOR ART)
FIG. 6 is a hydraulic circuit diagram of a conventional counterpart.

Referring to FIG. 1, there is illustrated an embodiment of the invention, wherein indicated at 20 is an engine which is mounted on a mobile type crane as shown in FIG. 5. A main hydraulic pump 22 is coupled with the engine 20 through a power transmission mechanism (PTO), while an auxiliary hydraulic pump 23 is directly coupled with the engine 20. A check valve 222 and a main relief valve 223 are connected to a conduit 221 on the discharge side of the main pump 22, and to a boom uplifting cylinder 50 (corresponding to the cylinder 4 in FIG. 5), through direction control valve 30, counter-balancing valve 33 and mode selector means 40.

The mode selector means 40 is provided with the following valves 41 to 45. The first change-over valve 41 is selectively switchable between position c for blocking oil flow from conduit 34 to conduit 35 while permitting reverse oil flow, and position d for communicating the conduits 34 and 35 with each other. The first change-over valve 41 may be an electromagnetic change-over valve, but normally it is constituted by a pilot-operated change-over valve which is held in position c when the accumlated pressure in the accumulator 53, applied to a pilot conduit 56, is lower than a preset level, and switched to position d when higher than the present level. The reference numeral 55 denotes a throttle.

The second change-over valve 42 is selectively switchable between position e for permitting oil flow from conduit 54 to conduit 35 while blocking reverse oil flow, and position f for communicating these conduits 35 and 54 with each other. The third change-over valve 43 is selectively switchable between position g for communicating conduit 231, which is connected to the auxiliary pump 23 (an auxiliary pressure source), with the pilot conduit 58, and position h for communicating the conduit 58 with the tank 24. The second and third change-over valves 42 and 43 are electromagnetic change-over valves which are switched in response to an electric signal from the controller 60. The reference numeral 232 indicates a relief valve.

The main pilot check valve 44 is so oriented as to permit oil flow from the conduit 32 to the conduit 35 while blocking reverse oil flow. The auxiliary pilot check valve 45 is so oriented as to block oil flow from the accumulator conduit 54 to drain conduit 57 while permitting reverse oil flow. These pilot check valves 44 and 45 are opened by the pilot pressure which is applied to the pilot conduit 58.

The controller 60 controls the positions of the change-over valves 42 and 43 on the basis of signals received from the transmission switch (PTO switch) 61, damper switch 62, pressure switch 63, boom length sensor 64, boom angle sensor 65 and suspended load sensor 66.

Figure 2:
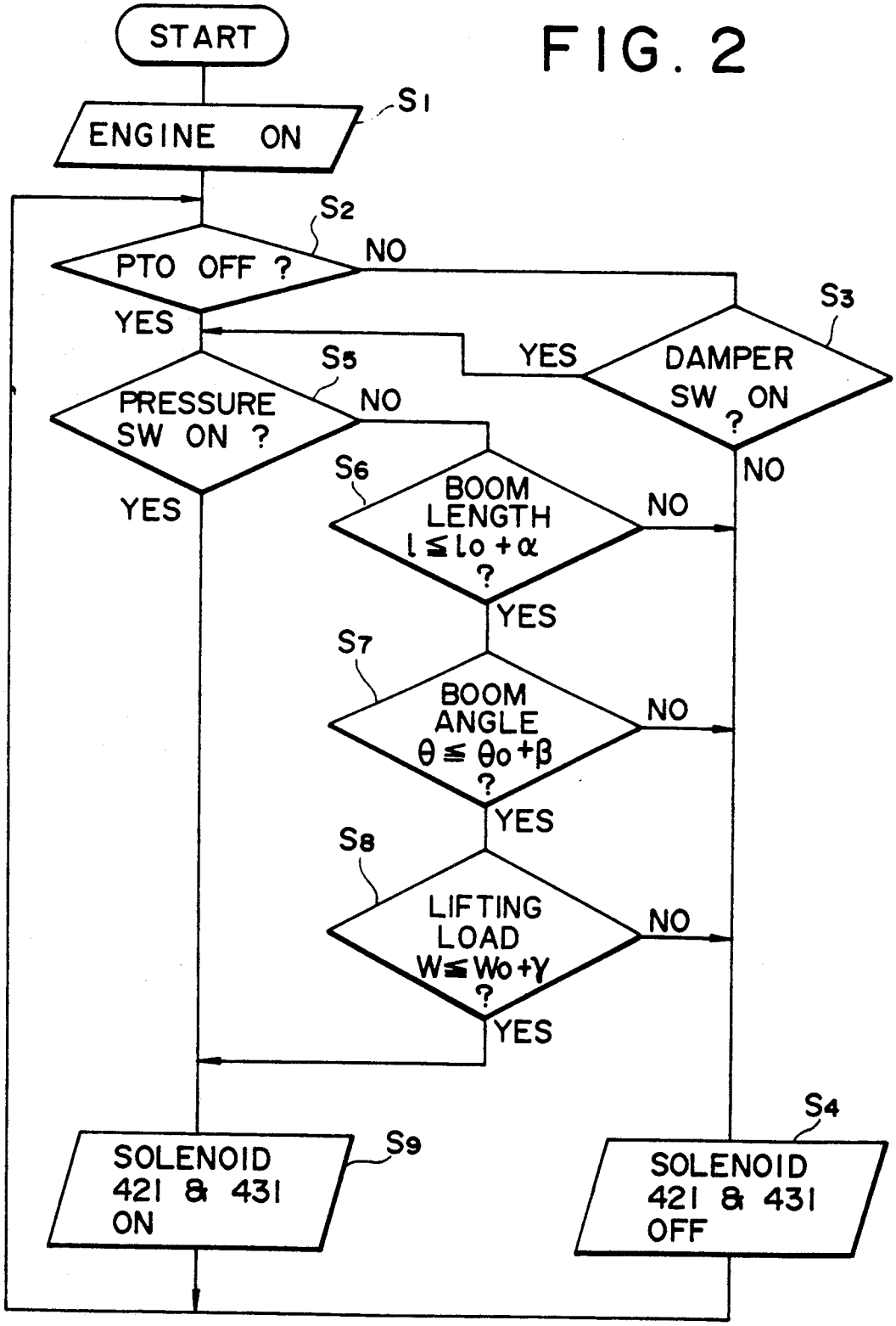
FIG. 2 is a flowchart of control for the hydraulic circuit.
Figure 3:
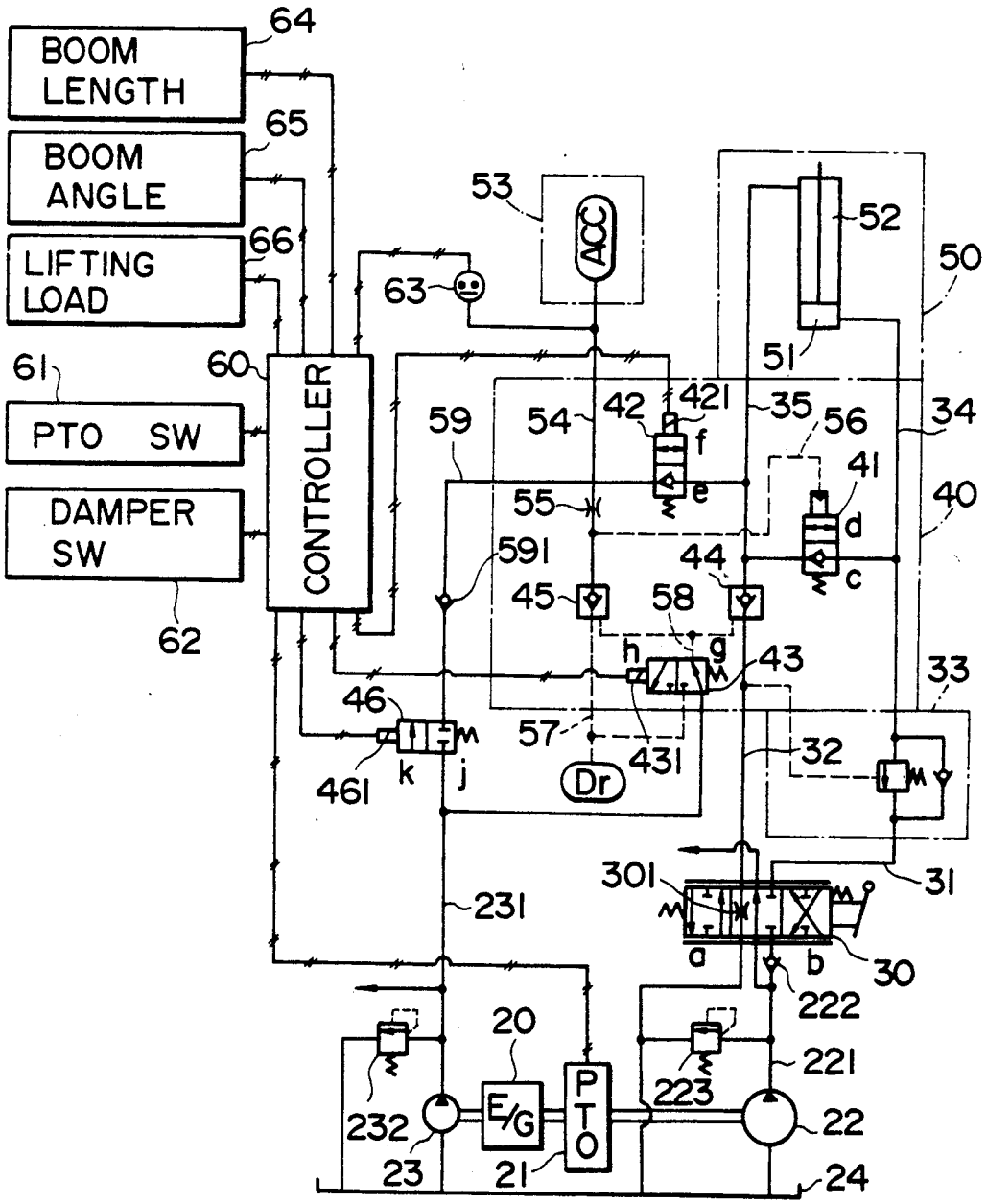
FIG. 3 is a diagram of a hydraulic circuit in another embodiment of the invention.

FIG. 2 is a flowchart of control by the controller 60.

In order to carry out a crane operation, the engine 20 as well as the transmission switch (PTO) 61 are turned on, whereupon the auxiliary pump 23 is driven and the transmission mechanism 21 is turned on to drive the main pump 22. On the other hand, since the damper switch 62 is off (the working mode), the control follows steps of S1→S2→S4 of FIG. 2, de-energizing the solenoids to hold the change-over valves 42 and 43 in positions e and a, respectively. Consequently, the discharge oil pressure of the auxiliary pump 23 flows into the pilot conduit 58 to open the pilot check valves 44 and 45, draining the accumulated pressure of the accumulator 53 to the tank pressure level through the auxiliary pilot check valve 45, holding the first change-over valve 41 in position c. At this time, the pressure switch 63 is in the off state.

Now, if the direction control valve 30 is switched to position a, the discharge oil pressure of the pump 22 flows into one oil chamber 51 through the counterbalancing valve 33, expanding the cylinder 50 to lift up the boom. The main pilot check valve 44 is open at this time, so that the oil which flows out of the other oil chamber 52 as a result of the expansion of the cylinder 50 returns to the tank 24 past the pilot check valve 44 and through the direction control valve 30. On the other hand, if the direction control valve 30 is switched to the boom-down position b, the discharge oil pressure of the pump 22 conversely flows into the oil chamber 52. Depending upon the inflow pressure, the counterbalancing valve 33 is opened to contract the cylinder 50 for a boom lowering operation.

Nextly, in order to start a vehicle driving operation from the working mode (with the transmission switch 61 on and the damper switch off), the boom 3 is contracted substantially into a fully shrunk state by operation of a boom stretching cylinder which is not shown, and the cylinder 50 (indicated at 4 in FIG. 5) is contracted also into a fully shrunk state to lower the boom 3 to the lower limit level. After removing a suspended load, if any, the crane hook (not shown) is strapped to the vehicle body 2 with a suitable degree of flexibility.

Thereafter, the damper switch 62 is turned on (travel mode), proceeding from step S3 to S5. At this time, the accumulated pressure of the accumulator 53 is at the level of the tank pressure and the pressure switch 63 is off, the control proceeds to step S6 and onwards. Since the boom length l, boom angle $\theta$ and suspended load weight W are all in safety ranges (appropriate values for vehicle travel), namely, in the ranges of $$l \leqq l_0+\alpha, \theta \leqq \theta_0+\beta, W \leqq W_O+\gamma$$

wherein l: Detected boom length;

$l_0$: Fully contracted boom length;

$\theta$: Detected boom angle;

$\theta_0$: Appropriate boom angle in vehicle travel;

W: Detected weight of suspended load; and $W_0$: Basic weight free of suspended load the answers in steps $S_6$, $S_7$ and $S_8$ are all "YES" and the control proceeds to step $S_9$. As a result, the solenoids 421 and 431 are energized to switch the change-over valves 42 and 43 to travel mode positions f and h, respectively, communicating the conduit 58 with the drain conduit 57 through the third change-over valve 43 in position h, closing the pilot check valves 44 and 45, and thus blocking oil flows from the conduit 35 to conduit 32 and from the conduit 54 to conduit 57. The conduit 35 is communicated with the conduit 54, namely, with the accumulator 53 through the second change-over valve 42 in position f. At this time point, the accumulated pressure of the accumulator 53 is lower than a preset level (the tank pressure), so that the first change-over valve 41 is retained in position c and the pressure switch 63 is still in an off state.

Then, by switching the direction control valve 30 to the boom-up position a, the discharge oil pressure of the main pump 22 is supplied to the oil chamber 51 of the cylinder 50 to expand the same. At this time, the pilot check valves 44 and 45 are closed and the second change-over valve 42 is in position f, and the oil from the oil chamber 52 of the cylinder is fed to and accumulated in the accumulator 53 without flowing toward the direction control valve 30.

If the accumulated pressure in the accumulator 53 exceeds the preset level, the first change-over valve 41 is switched to position d, establishing communication between the conduits 34 and 35 and between the two oil chambers 51 and 52. Now the pressure switch 63 is turned on, so that the control proceeds from step $S_5$ to step $S_9$, holding the change-over valves 42 and 43 in positions f and h, respectively. Then, if the direction control valve 30 is continually retained in the boom-up position a, the discharge oil pressure from the pump 22 is continually supplied to the oil chamber 51, further expanding the cylinder 50 for a boom uplifting operation. In this instance, although the cylinder 50 is expanded in the fashion of a ram cylinder, there is no possibility of the pressure in the oil chamber 51 rising to an abnormally high level since the boom 3 is fully contracted state and free of any suspended load.

In this manner, the pressure is accumulated in the accumulator 53, and the cylinder 50 is extended slightly from its fully contracted state, raising the boom 3 to the appropriate height $H_1$ for travel from the lower limit height $H_0$. Then, upon returning the direction control valve 30 to neutral position, the cylinder 50 is stopped and its oil chambers 51 and 52 are communicated with each other by a closed circuit in communication with the accumulator 53. The appropriate travelling height $H_1$ for the boom 3 should be higher than the lower limit height $H_0$ and lower than an upper limit height $H_2$ as prescribed in traffic regulations, namely, $H_0<H_1<H_2$.

Now, the transmission switch (PTO switch) 61 is turned off, and the vehicle is moved by driving the wheels 1 by a vehicle driving mechanism. When the vehicle is in travel, the vehicle body 2 is vibrated or put in quaky movements due to undulations or irregularities on road surfaces and accelerations and decelerations of the vehicle, accompanied by vertical quaky movements of the boom 3 which tend to telescopically stretch and contract the cylinder 50. However, since the two oil chambers 51 and 52 are communicated with each other and with the accumulator 53, the pressure fluctuations resulting from the telescopic movements of the cylinder 50 are suppressed by damping actions of the accumulator 53 and the oil pressure losses in the conduits of the above-described closed circuit, damping vibrations and quaky movements of the vehicle body 2 to give an improved feeling of ride to the operator. The above-described arrangement in which the transmission switch (PTO switch) 61 and the transmission mechanism 21 are turned off with the main pump 22 at rest during the vehicle travel has an effect of energy saving. Although the auxiliary pump 23 is constantly driven from the engine 20, its discharge oil pressure is effectively used as a pressure source for clutches and brakes instead of being supplied to the accumulator.

In a case where the vehicle drops by a gas station for fuel refilling in the course of a vehicle driving operation, temporarily cutting off the engine 20 and pulling out the key to turn off the power switch, the change-over valves 42 and 43 are returned to positions e and g (working mode positions), communicating the conduit 231 with the conduit 58. However, since the auxiliary pump 23 is also stopped at this time, there are no possibilities of the pilot check valves 44 and 45 being opened and permitting the accumulated oil pressure in the accumulator 53 to flow out toward the tank 24. Accordingly, the cylinder 50 is maintained in a predetermined length to retain the boom 3 at the appropriate height H1 for vehicle travel. On the other hand, the accumulated pressure in the accumulator 53 is at a level which is higher than the predetermined pressure level, so that the first change-over valve 41 is held in the switched position d. The pressure switch 63 is in an on-state but no current flows therethrough.

In this manner, even if the engine is temporarily cut off, the accumulated pressure of the accumulator 53 is retained at a level higher than the predetermined pressure level, so that there is no need for freshly accumulating pressure when re-starting the vehicle after fuel refilling or the like, thereby comprising memory means. Further, at the time of re-starting the vehicle, upon turning on the power switch and starting the engine 20 with the transmission switch in the off-state, the on-signal of the power switch 63 which has been retained in an on-position by the accumulated pressure of the accumulator 53 is fed to the controller, advancing the control to S1→S2→S5→S9. Consequently, the change-over valves 42 and 43 are immediately switched to positions f and h automatically to restore the vehicle travel mode positions existing before the engine was cut-off, thereby comprising control means responsive to the memory means. It follows that the vehicle driving operation becomes possible upon simply re-starting the engine 20 without turning on the damper switch 62 again. Thus, the vehicle re-starting operation is extremely facilitated, while ensuring the desired damping action during and after the re-starting operation.

For starting a crane operation after a vehicle driving operation, the transmission switch 61 and the damper switch 62 are turned on (the working mode), whereupon the power transmission mechanism 21 is actuated to drive the main pump 22. In this instance, as soon as the just-mentioned switches are turned on, the change-over valves 42 and 43 are returned to working mode positions e and g ($S_1 \rightarrow S_2 \rightarrow S_3 \rightarrow S_4$), and the pilot check valves 44 and 45 are opened, communicating the conduits 35 and 32 to open the closed circuit. At the same time, the conduits 54 and 35 are communicated with each other, draining the accumulated pressure of the accumulator 53 to the tank 24 through the auxiliary pilot check valve 45 into the level of the tank pressure, and returning the first change-over valve 41 to position c. Accordingly, even when a boom uplifting operation is carried out immediately after the switch to the working mode, the cylinder 50 does not form a ram cylinder and can be operated normally without interference by the accumulator to permit a smooth crane operation.

Figure 4A:
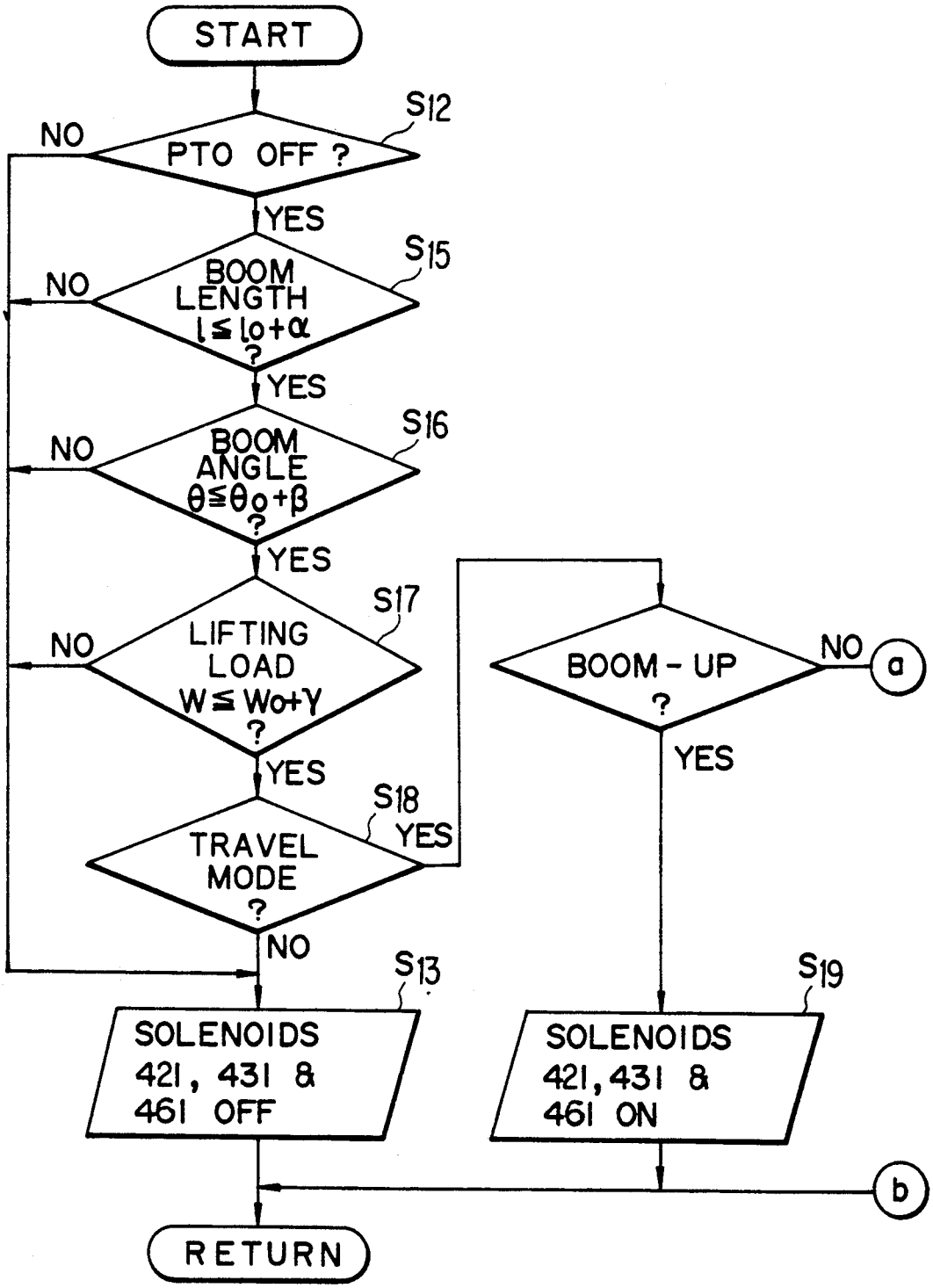
FIGS. 4, 4*a*, and 4*b* show a flowchart of control for the hydraulic circuit of FIG. 3.
Figure 4:
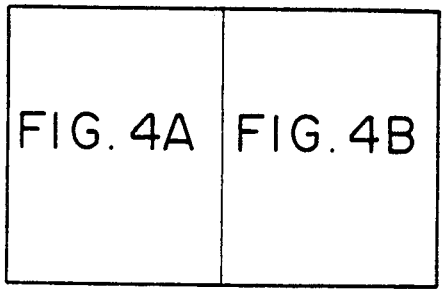
Figure 4B:
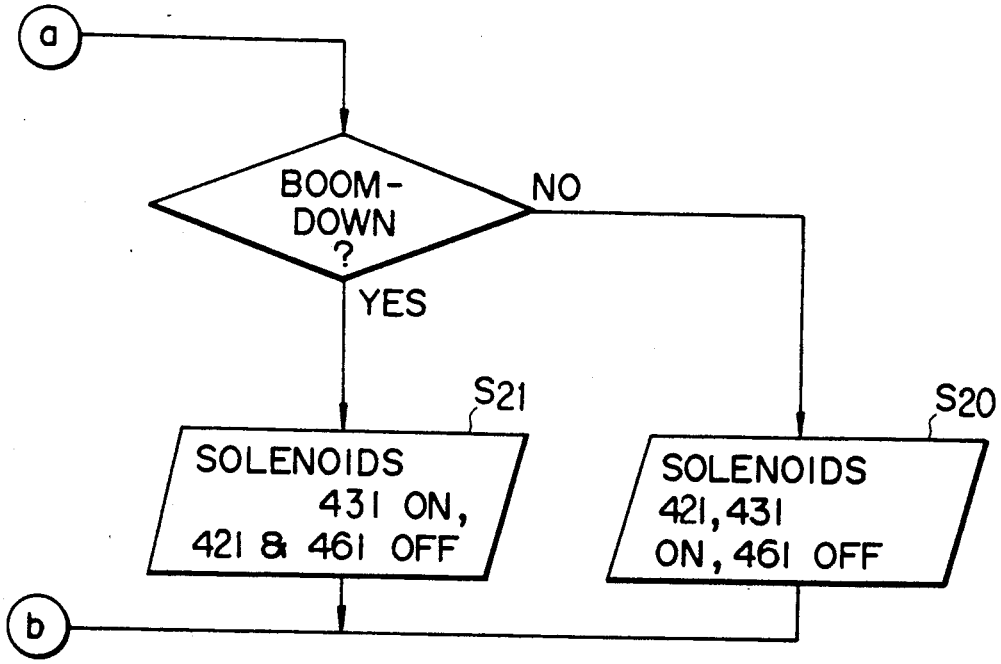

In the foregoing embodiment, the pressure accumulation in the accumulator 53 and the adjustment to the appropriate travel height $H_1$ of the cylinder 50 are effected by the discharge oil pressure of the main pump 22. However, this can be done by the use of the discharge oil pressure of the auxiliary pump 23 as shown in FIGS. 3, 4, 4*a*, and 4*b*. The embodiment of FIG. 3 has a fourth change-over valve 46 added to the hydraulic circuit as shown FIG. 1, and is operated under the control as illustrated in the flowchart of FIGS. 4, 4*a*, and 4*b*.

Referring to FIGS. 3, 4, 4*a*, and 4*b* in case of carrying out a crane operation, upon turning on the engine 20 and transmission switch 61, the control proceeds to steps $S_{12} \rightarrow S_{13}$, de-energizing the solenoids 421, 431 and 461 to hold the change-over valves 42, 43 and 46 in positions e, g and j (working mode positions) shown. In this state, by switching the direction control valve 30 to a boom-up or boom-down position, the cylinder 50 is expanded or contracted in the same manner as in the embodiment of FIG. 1 for effecting a boom uplifting or lowering operation.

Now, in order to drive the vehicle, the boom length l, boom angle $\theta$ and suspended load weight W are firstly set at a value smaller than the respective preset value in the working mode under engine driving conditions, and then the transmission switch 61 is turned off to stop the operations of the transmission mechanism 21 and the main pump 22. The accumulated pressure of the accumulator 53 is level with the tank pressure at this time, with the pressure switch 63 in off the state, and the boom length l, boom angle $\theta$ and suspended load weight W are all in the appropriate value for travel, so that the control proceeds to the steps of $S_{12} \rightarrow S_{15} \rightarrow S_{16} \rightarrow S_{17} \rightarrow S_{18}$.

Thereafter, upon turning on the damper switch 62, if the boom is up, i.e. at level $H_1$, the control proceeds to the step S19, energizing the solenoids 421, 431 and 461 to switch the change-over valves 42, 43 and 46 to positions f, h and k, respectively, thereby closing the pilot check valves 44 and 45 and communicating the conduits 35, 54, 59 and 231 with each other. As a result, the discharge oil pressure of the auxiliary pump 23 is supplied to and accumulated in the accumulator 53 through the check valve 591 and conduits 59 and 54, switching the change-over valve 41 to position d as soon as the accumulated pressure exceeds the predetermined level to communicate the two oil chambers 51 and 52 of the cylinder 50 through a closed circuit which is in communication with the accumulator 53.

If, however, the boom is fully down, it should be raised to level $H_1$.

In case the damper switch 62 is of a push button type, it is kept in an on-state (the vehicle travel mode) while it is depressed, and turned off (the working mode) as soon as it is relieved of a depressing force. Accordingly, while the switch 62 is depressed continually, the discharge oil pressure of the auxiliary pump 23 is accumulated in the accumulator 53, and the change-over valve 41 is switched to position d to form the closed circuit. Then, the discharge oil pressure of the pump 23 flows into the closed circuit, expanding the cylinder 50 to uplift the boom 3. If the operator's finger is released from the switch 61 in an initial stage of the movement of the boom 3, i.e., upon confirming that the height of the boom has reached to the appropriate level $H_1$ for travel, the control proceeds from step $S_{18}$ to step $S_{20}$, keeping the solenoids 421 and 431 energized to hold the change-over valves 42 and 43 continuedly in positions f and h, and de-energizing the solenoid 461 to return the change-over valve 46 to position k thereby stopping the pressure replenishment (accumulation) from the pump 23 to the accumulator and closed circuit to put the vehicle in condition for travel. On the other hand, if the boom is to stay at level Ho, control proceeds to step S21.

As will be understood from the foregoing description, the pressure accumulation for the accumulator 53 and the adjustment of the cylinder 50 are effected by the use of the discharge oil pressure of the auxiliary pump 23 with the transmission mechanism 21 and main pump 22 in off-state, so that the operation is simplified as compared with the embodiment of FIGS. 1 and 2, in addition to smooth pressure accumulation and cylinder adjustment.

Further, the accumulated pressure would not be drained from the accumulator 53 even if the engine 20 and the power switch were cut off, and, similarly to the foregoing embodiment, there is no need for freshly accumulating pressure in the accumulator 53 at the time of re-starting the vehicle. Upon re-starting the engine 20, the change-over valves 42 and 43 are automatically switched to positions f and h by the control of steps $S_{12} \rightarrow S_{15} \rightarrow S_{16} \rightarrow S_{17} \rightarrow S_{18} \rightarrow S_{20}$, ensuring comfortable ride with the vibration damping action.

As will be appreciated from the foregoing description, the present invention has a number of advantages as follows.

(1) The comfort of ride in vehicle driving operations is improved by the vibration damping action of the boom uplifting hydraulic cylinder and accumulator. Especially in a case where the engine is temporarily cut off for refilling fuel in the course of vehicle travel, the accumulated pressure of the accumulator is maintained at the vehicle travel level, so that, when re-starting the vehicle later on, the mode selector means can be automatically returned to travel mode position upon re-starting the engine. Therefore, there is no need for setting the mode selector means in the vehicle travel mode position every time when re-starting the vehicle.

(2) The memory means exactly stores the operating condition immediately before an engine cut-off by way of the accumulated pressure level of the accumulator even after the power switch has been turned off, improving the controllability by promptly reproducing the stored operating condition upon re-starting the engine.

(3) In case the mode selector means employs first to third change-over valves in combination with main and auxiliary pilot check valves, the operation can always be switched appropriately between the vehicle travel mode and the working mode, securely preventing the accumulated pressure from being drained from the accumulator when the engine is cut off after a vehicle driving operation, and reproducing the vehicle travel mode smoothly at the time of re-starting the vehicle.

(4) In case the discharge oil pressure of the auxiliary pump is used for the pressure accumulation in the accumulator through the fourth change-over valve, the operations prior to a vehicle driving operation, including the pressure accumulation and setting of the cylinder in an appropriate condition for vehicle travel, are extremely simplified.

(5) Where the first change-over valve is a piloted change-over valve, the closed circuit is formed only after the accumulator pressure has exceeded a predetermined pressure level, preventing the contraction of the cylinder which would otherwise occur at the time of switching the mode of operation, holding the cylinder at a standstill while accumulating the pressure.

(6) The accuracy of control and the efficiency in vehicle driving operations and crane operations are improved by controlling the mode selector means by combinations of signals from the transmission switch, damper switch and memory means.

What is claimed is:

1. An apparatus for suppressing vibratory or quaky movements of a mobile type crane having a vehicle body and an engine, said apparatus reproducing, following restarting of the engine, a condition existing prior to engine shut off, comprising:

a boom including a hydraulic cylinder having operatively opposing first and second oil chambers, the boom pivotally supported on the vehicle body through said hydraulic cylinder for pivoting movements about a horizontal axis;

a direction control valve for respectively, selectively supplying and draining discharge oil pressure to and from the first load-holding oil chamber and the opposing second oil chamber of said hydraulic cylinder;

a counter-balancing valve provided at a position fluidically between said hydraulic cylinder and said direction control valve;

an accumulator selectively fluidically connected to said hydraulic cylinder at a position fluidically between said hydraulic cylinder and said counter-balancing valve and comprising means for suppressing vibrations of said vehicle body;

a mode selector means selectively switchable between a travel mode position wherein said mode selector means comprises means for communicating said first and second oil chambers with each other through a closed circuit in communication with said accumulator and a working mode position wherein said mode selector means comprises means for opening said closed circuit, supplying oil pressure to and from said first and second oil chambers independently of each other and isolating said accumulator from said hydraulic cylinder;

memory means for electronically storing information as to the mode of operation of said mode selector means under engine operating conditions; and a controller comprising means for reproducing automatically after an in-transit engine cut-off the mode of operation in existence before the engine cut-off, by setting said mode selector means in a reproducing position upon re-starting said engine based on information stored in the memory means.

2. An apparatus as defined in claim 1, wherein said memory means comprises means for storing information as to whether or not the accumulated pressure of said accumulator is at an appropriate value for vehicle travel.

3. An apparatus as defined in claim 1 or 2, further comprising a main hydraulic pump disconnectibly coupled with said engine through a transmission mechanism, and an auxiliary hydraulic pump constantly driven from said engine, and wherein said mode selector means comprises: a first change-over valve selectively switchable between a working mode position for blocking oil flow from said first to second oil chamber, and a travel mode position for communicating said two oil chambers with each other; a second change-over valve selectively switchable between a working mode position for blocking oil flow from said second oil chamber to said accumulator, and a travel mode position for communicating said second oil chamber with said accumulator; a main pilot check valve comprising means to block oil flow from said second oil chamber to said direction control valve; an auxiliary pilot check valve comprising means to block oil flow from said accumulator; and a third change-over valve having a valve opening pilot conduit and selectively switchable between a working mode position for applying the pilot pressure from said auxiliary pump to the valve-opening pilot conduit for opening said pilot check valves, and a travel mode position for draining said pilot conduit.

4. An apparatus as defined in claim 3, further comprising a fourth change-over valve selectively switchable between a replenishing position for supplying the oil pressure from said auxiliary pump to said accumulator and a blocking position for inhibiting the pressure replenishment.

5. An apparatus as defined in claim 3, wherein said first change-over valve is a piloted change-over valve adapted to be held in said working mode position when the pilot pressure applied from the accumulator conduit between said second change-over valve and said accumulator is lower than a preset level, and switched to said travel mode position when higher than the preset level, wherein the remaining change-over valves are each comprised by an electromagnetic valve.

6. An apparatus as defined in claim 3, further comprising a transmission switch to turn on and off said transmission mechanism, and a damper switch to select or deselect the travel mode of said mode selector means, and wherein said controller comprises means for controlling the switching operation of said mode selector means according to signals from said switches and from said memory means.

* * * * *